US007928050B2

(12) United States Patent
Schneiderman et al.

(10) Patent No.: US 7,928,050 B2
(45) Date of Patent: Apr. 19, 2011

(54) LIQUID LAUNDRY DETERGENT COMPOSITIONS WITH IMPROVED STABILITY AND TRANSPARENCY

(75) Inventors: Eva Schneiderman, Fairfield, OH (US); Genevieve Cagalawan Wenning, Villa Hills, KY (US); Peggy Marion Teyssier, Milford, OH (US); David Robert Nassano, Alexandria, KY (US); David Kent Rollins, Cincinnati, OH (US); Donna Jane Wiedemann, West Harrison, IN (US); Arturo Luis Casado Dominguez, Brussels (BE); Rajan Keshev Panandiker, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 12/788,936

(22) Filed: May 27, 2010

(65) Prior Publication Data

US 2010/0305920 A1 Dec. 2, 2010

Related U.S. Application Data

(62) Division of application No. 11/403,602, filed on Apr. 13, 2006.

(60) Provisional application No. 60/671,670, filed on Apr. 15, 2005.

(51) Int. Cl.
*C11D 1/22* (2006.01)
*C11D 1/66* (2006.01)
*C11D 3/26* (2006.01)
*C11D 3/37* (2006.01)

(52) U.S. Cl. ..... 510/340; 510/336; 510/351; 510/352; 510/357; 510/475; 510/499

(58) Field of Classification Search ..... 510/321, 510/336, 337, 340, 351, 352, 357, 393, 475, 510/499
See application file for complete search history.

(56) References Cited

U.S. PATENT DOCUMENTS

| | | | |
|---|---|---|---|
| 5,565,145 | A | 10/1996 | Watson et al. |
| 5,587,356 | A | 12/1996 | Dauderman et al. |
| 5,731,278 | A | 3/1998 | Nair et al. |
| 5,952,285 | A | 9/1999 | Hawkins et al. |
| 6,051,543 | A | 4/2000 | Tarng et al. |
| 6,221,825 | B1 | 4/2001 | Williams, Jr. et al. |
| 6,730,650 | B1 | 5/2004 | Wood |
| 2005/0059568 | A1 | 3/2005 | Hines |

FOREIGN PATENT DOCUMENTS

| | | | |
|---|---|---|---|
| EP | 0 971 022 | A | 1/2000 |
| WO | WO 99/27065 | A | 6/1999 |
| WO | WO 2004/024858 | | 3/2004 |
| WO | WO2004/024858 | * | 3/2004 |

* cited by examiner

*Primary Examiner* — Gregory R Del Cotto
(74) *Attorney, Agent, or Firm* — Stephen T. Murphy

(57) ABSTRACT

An improved method for predicting stability of liquid detergent composition, identifying and designing liquid detergent compositions that provide said desired stability, consumer acceptance and performance.

2 Claims, 1 Drawing Sheet

LIQUID LAUNDRY DETERGENT COMPOSITIONS WITH IMPROVED STABILITY AND TRANSPARENCY

CROSS REFERENCE TO RELATED APPLICATION

This application is a Divisional application under 35 U.S.C. §121 of U.S. application Ser. No. 11/403,602, filed Apr. 13, 2006 and claims benefit of and priority to U.S. Provisional Ser. No. 60/671,670 filed Apr. 15, 2005.

FIELD OF THE INVENTION

The present invention relates to an improved method for predicting stability of liquid detergent composition and/or identifying and designing liquid detergent compositions that provide said desired stability and/or consumer acceptance and/or performance. Present invention also relates to liquid detergent compositions having desired formulation tolerance and consisting of surfactants, polymers, alkoxylated polyethyleneimines, enzymes, hydrotropes, solvents, stabilizers, perfumes, colorants, builders, electrolytes, and other adjunct ingredients.

BACKGROUND OF THE INVENTION

A clear and transparent liquid detergent composition that provides maximum performance benefits when laundering fabrics continue to be desired by users of such compositions. Often modification of one ingredient such a composition causes a haze or cloudiness and results in a decreased product acceptance by the users. This haziness/is believed to be caused by a complex interplay of the many functional additives in such a composition and thus limit selection of active ingredients that can enhance performance of the liquid detergent composition. Prediction of stability and clarity relies on empirical experimentation, which may be altered with the addition of performance enhancers causing the product to become hazy and unstable and even causing phase separation.

Furthermore it has been found that consumer acceptance of liquid detergent formulations is not only driven by the cleaning performance, but also by its appearance and its clarity. The clear and the more transparent product is, the better it will be accepted by the consumers.

An important area of cleaning is removal of greasy and oily soils. Often the most effective surfactants for greasy and oil soil removal contribute to decreased transparency of a fully formulated liquid laundry compositions. The problem of surfactant contribution to the decreased clarity may be addressed via use of solvents such as glycols, polyols and others and hydrotropes such as cumene sulfonate, however it is desired to minimize the inclusion of such non-cleaning components of a liquid detergent composition.

Materials other than surfactants which can improve greasy and oil soil cleaning are polymeric materials, however effective formulation and stability of liquid detergent compositions with some polymeric materials further cause undesired clarity and transparency.

One way to address the formulation problem of liquid detergent compositions generally and more specifically, the formulation of polymeric materials into a liquid detergent composition has been found to be addressed by altering the surfactant system that reduces the level of linear alkyl sulfonate surfactants (LAS), and increases levels of ethoxy sulfate surfactants and nonionic surfactants. Another embodiment changes the ionic strength of the composition. However, alkyl ethoxy sulfate surfactants and nonionic surfactants are more hydrophilic than LAS surfactants, thus reduction of LAS level in the composition may make hydrophobic soils such as grease and oil soils more difficult to remove.

In addition, surprisingly it has been found that the reduction in LAS is required, said compositions still require some level of LAS to minimize the amount of wrinkles that result in clothes washed in the described liquid detergent compositions. Thus it is extremely important to define composition component boundaries to achieve the formulatibility of desired compositions, and formulatibility of other performance enhancing actives such as polymers to achieve a transparent/clear composition with optimized soil cleaning.

SUMMARY OF THE INVENTION

The present application relates to a liquid detergent composition consisting essentially of: (a) from about 8% to about 18% by weight of a surfactant system comprising from 0.01 wt % to about 9 wt % by weight of the composition of $C_{8-15}$ alkyl benzene sulfonate and from 0 wt % to about 5 wt % by weight of the composition of a nonionic surfactant; (b); from about 0.01 wt % to about 5 wt % by weight of the composition of a formulation salt modifier; and (c) from about 20 wt % to about 85 wt % by weight of the composition of an aqueous liquid carrier being essentially free of cumene sulfonate; wherein the liquid detergent compositions gives a Formulation Tolerance greater than 33, and has a viscosity of from about 100 to about 800 centipose.

The present invention also relates to a method of making a liquid laundry detergent composition comprising the steps of: (a) forming a liquid matrix containing the surfactant system, the liquid carriers being thoroughly admixed by imparting shear agitation to for a liquid phase; (b) predissolving solid form ingredients to form solution and adding them, except for an enzyme component, to form a mixture; (c) Adding solid form ingredients except for an enzyme component to form a mixture (d) agitating the mixture to form a solution or a uniform dispersion of insoluble solid phase particulates within the liquid phase; and (e) adding a enzyme component to the solution or uniform dispersion to form the composition; wherein agitation is continued for a period of time sufficient to form compositions having a desirable transparency.

The present invention also relates to a method for designing liquid detergent compositions such that the Formulation Tolerance is larger than 33.

DETAILED DESCRIPTION OF THE INVENTION

Figure 1:
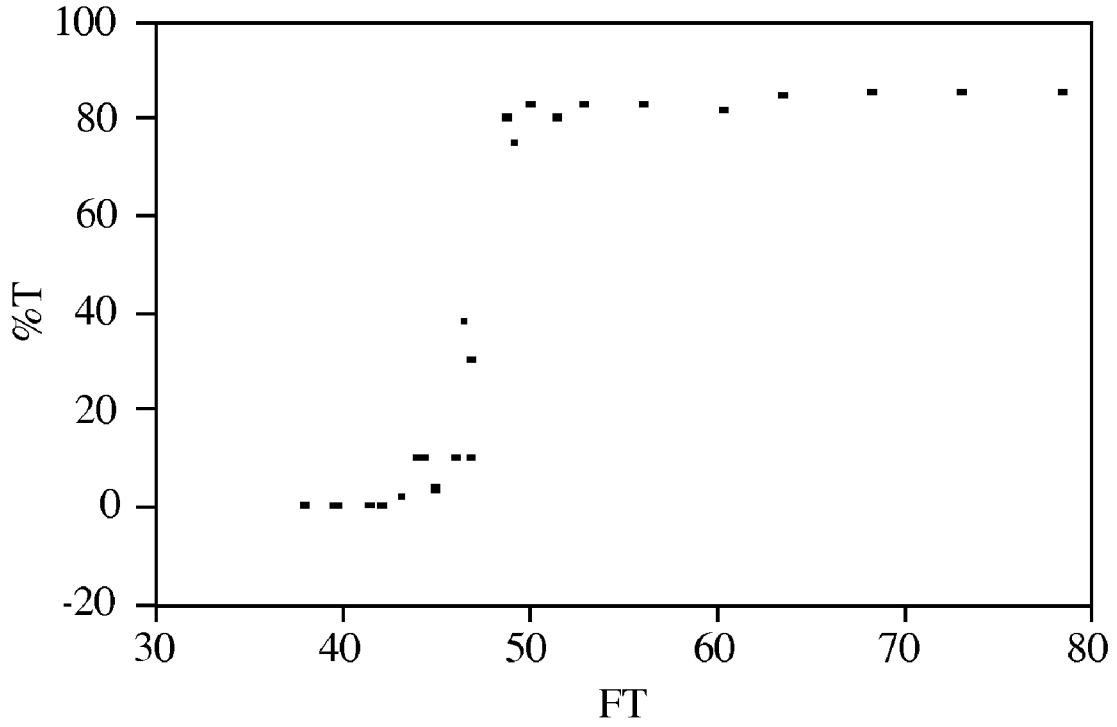
FIG. 1 is a graph depicting the dependence of % T on Formulation Tolerance of a finished liquid detergent composition when PEI 5000 EO10PO7 is used as a performance enhancer.

As used herein "finished liquid detergent composition" includes, but is not limited to the required components of the liquid detergent composition of the present invention. Optional components described herein may be included in the "finished liquid detergent composition" but should not affect the desired transparency, with the exception of dyes and light dispersing agents, such as opacifying agents. The inclusion of dyes and light dispersing agents may be included, but the desired transparency relates only to the finished liquid detergent composition before the addition of such materials.

As used herein "consisting essentially of" refers to the basic and novel characteristic of having the defined Formulation Tolerance. This is physically manifested in the measurement of % T further discussed below.

% T of Liquid Detergent Formulation

As used herein, "desired transparency" means percent of light that has not been absorbed and/or dispersed by a finished liquid detergent composition. % T was measured at 440 nm wavelength in a cuvette with 1 cm pathlength utilizing standard spectrophotometer and/or alternative instrument, taking into consideration recommendations of a manufacturer for the optimum use of such instrument. It is important to note that samples have to be free of bubbles for accurate readings. Under the disclosed conditions of the measurement, 100% transparency was assigned to deionized water. It is also important to note that % T of finished liquid detergent composition was measured prior to addition of materials that are light absorbing such as dyes and/or light dispersing agents, such as opacifying agents.

In this application the most preferred desired transparency of finished formulas at 440 nm and 1 cm pathlength are higher than 30%, even more preferable higher than 40% (40% to 100%), even more preferable higher than 50%, even more preferable higher than 60%.

Incorporated and included herein, as if expressly written herein, are all ranges of numbers when written in a "from X to Y" or "from about X to about Y" or "X-Y" format. It should be understood that every limit given throughout this specification will include every lower or higher limit, as the case may be, as if such lower or higher limit was expressly written herein. Every range given throughout this specification will include every narrower range that falls within such broader range, as if such narrower ranges were all expressly written herein.

Unless otherwise indicated, weight percentage is in reference to weight percentage of the composition. All temperatures, unless otherwise indicated are in Celsius.

Formulation Tolerance

It is believed that clarity and stability of a liquid detergent composition can be predicted by an empirical index referred to herein as "Formulation Tolerance". Formulation Tolerance of liquid detergent composition of the present invention should be larger than 33, more preferably larger than 35, more preferably larger than 39, even more preferably larger than 40, and even more preferably larger than 45. Formulation Tolerance is characterized by a strategic selection of the surfactant system via the hydrophilic index ($HI_C$) and by a strategic selection of ionic materials such as electrolytes surfactants, polymers, builders, among other know ionic materials via the ionic strength (IS). Formulation Tolerance (FT) is calculated as the ratio of hydrophilic index ($HI_C$) and ionic strength multiplied by the total weight % of surfactant in a finished liquid detergent composition:

$$FT=(HI_C/IS)*\Sigma_y \text{ (weight \% of surfactant } y \text{ in a finished liquid detergent composition)}$$

where FT is the Formulation Tolerance of a finished liquid detergent composition, $HI_C$ is hydrophilic index of a finished liquid detergent composition, IS is the ionic strength of a finished liquid detergent composition, and $\Sigma_y$ (weight % of surfactant y in a finished liquid detergent composition) is weight % of all surfactants in the finished liquid detergent composition. It has been found that in general Formulation Tolerance should be larger than 33, more preferably larger than 35, more preferably larger than 39, even more preferably larger than 40, and even more preferably larger than 45.

Hydrophilic Index

The hydrophilic index of surfactant system is based upon the calculation of HLB (hydrophile-lipofile balance) of surfactants. The calculation of HLB is further discussed in "Surfactants and Interfacial Phenomena" by M. J. Rosen. In this application, HLB is applied to ionic surfactants. A surfactant molecule comprises of hydrophilic portion (being referred to as the head) and hydrophobic portion (being referred as the tail). The total hydrophobicity of a surfactant system can be calculated as $HI_S$:

$$HI_s=100/5*(MW_{hydrophilic}/MW_{total\ ion})$$

Where $MW_{hydrophilic}$ is the molecular weight of the head and $MW_{total\ ion}$ is the molecular weight of the ionic form of the surfactant.

For example HI index of sodium laurate is:

$$HI_{sodium\ laurate}=100/5*(MW_{SO4-}/MW_{lauryl\text{-}SO4-})=100/5*(96/265)=7.24$$

$HI_C$ (hydrophilic index of a composition) is a measure of hydrophobicity of a surfactant mixture and is calculated as $HI_C$:

$$HI_C=\frac{\left[\sum_y \text{(weight \% of surfactant ion } y \text{ in a finished liquid detergent composition)} \times (HI_{Sy})\right]}{\sum_y \text{(weight \% of surfactant ion } y \text{ in a finished liquid detergent composition)}}$$

Where [$\Sigma_y$ (weight % of a surfactant ion y in a finished liquid detergent composition)×($HI_{Sy}$)] is the sum of the products of weight percent of a surfactant in a finished detergent composition and its hydrophilic index (formula II) and $\Sigma_y$ (weight % of surfactant ion y in a finished liquid detergent composition) is the total weight percent of surfactant in a finished detergent composition.

For example if a finished liquid detergent composition contains a total of 10% by weight of the composition of a 1:1 weight ratio of decyl sulfate and lauryl sulfate, the $HI_C$ of this composition can be calculated as follows:

$$HI_{decyl\ sulfate}=100/5*(MW_{SO4-}/MW_{decyl\text{-}SO4-})=100/5*(96/237)=8.10$$

$$HI_{lauryl\ sulfate}=100/5*(MW_{SO4-}/MW_{lauryl\text{-}SO4-})=100/5*(96/265)=7.24$$

$$HI \text{ 1:1 decyl:lauryl at 10 wt \% total level}=(5*7.24+5*8.1)/10=7.67$$

Ionic Strength—IS

Ionic Strength, IS, above, is a measure of ion concentration in a finished liquid detergent formulation. The basis of the calculation is based in the Debye-Hückel theory of strong electrolytes, however the original formula from this theory has been modified for the purposes of this application. In this application ionic strength is calculated:

$$IS=(\Sigma_{(\text{weight \% of species in a finished liquid detergent composition})}/MW_s*0.5*n*q^2))*1000\% \text{ water}$$

where IS is ionic strength, weight % of species in a finished liquid detergent composition is weight percent of species from which an ion can be formed in the composition, $MW_s$ is molecular weight of a species from which an ion y can be formed, $n_y$ is number of ions, % water is weight percent of the water in the composition, and q is the charge of the ion in the composition under the pH of the finished liquid detergent composition.

For example ionic strength of a mixture of 1% sodium chloride and 1% sodium citrate at pH 9 can be calculated ($MW_{sodium\ chloride}$=58, $MW_{sodium\ citrate}$=260):

$$IS_{NaCl+Na\ citrate}=(1/58*0.5*1*1^2+1/58*0.5*1*1^2+1/260*0.5*1*3^2+1/260*0.5*3*1^2)*1000/98=0.411$$

For the purposes of the present application, the contribution of $H^+$ ions and/or $OH^-$ ions to ionic strength are excluded as their concentration is negligible when compared to concentration of other ion species in the finished liquid detergent composition.

Not being bound by any particular theory, it has been found that formulation of performance and/or stability enhancing agents such as cationic and zwitterionic co-surfactants and polymers require higher Formulation Tolerance compared to liquid detergent compositions not containing such surfactants and/or polymers.

It has been found that generally % T of a liquid detergent composition is a function of Formulation Tolerance and follows an S-curve example of which is shown in FIG. 1.

One embodiment of the surfactant system of the present application comprises an alkyl ethoxy sulfate surfactant, a linear alkyl benzene sulfonate surfactant (LAS), a nonionic surfactant, and optionally other cationic/zwitterionic surfactants, where the alkyl ethoxy sulfate is at least equal, more preferably the dominate surfactant compared to any other surfactant in the mixture. Such a surfactant system is a hydrophilic surfactant system and cleaning of hydrophobic soils such as grease and oil will decrease. The addition of an alkoxylated polyethyleneimine polymer (PEI) may be used to improve grease and oil cleaning and other hydrophobic soil cleaning.

Formulation of this polymer into a clear and transparent liquid detergent composition requires Formulation Tolerance of higher than 39, more preferred higher than 45, more preferably higher than 47, even more preferably higher than 48 to result in a composition with acceptable % T. FIG. 1 above shows % T of a liquid detergent composition comprising an alkoxylated polyethyleneimine polymer as a function of formulation tolerance. Without being bound by any particular theory, addition of alkoxylated polyethyleneimine with a higher molecular weight backbone (molecular weight from 3000 to about 10000) will result in an upward shift in Formulation Tolerance to be able to formulate into a clear and transparent liquid detergent formulation. Similarly, the ionic charge of the PEI, such as, but not limited to, quaternization of the backbone, sulfation, sulfonation, carboxylation, phosphorylation, and the like, will decrease the Formulation Tolerance of finished liquid detergent composition compared to that of the neutral PEI equivalent.

Another embodiment of the present invention is a liquid detergent formulation with the desired Formulation Tolerance having an optimum ionic strength. One way is to decrease the level of organic builder such as citric and/or tartaric acid, this however may cause undesirable effects on hydrophilic soil cleaning such as clays, grass, wine, grape juice, and others. This undesirable effect must be compensated for by addition of variety of polymers, or calcium and/or transition metal entrapping agents. Another way is to decrease the level borate. This however may cause undesirable effects on enzyme stability and functionality of HDL, and/or microbial growth control of HDL on shelf. Yet another way to achieve desirable Formulation Tolerance of finished detergent composition is to decrease/eliminate level of formulation salt modifier. However this may have an effect on viscosity of said liquid detergent formulations, and should be compensated for by use of other viscosity modifiers.

Furthermore, finished liquid detergent compositions can be formulated with low Formulation Tolerance, however haziness and instability of such formulations must be addressed by addition of higher level of rheology modifiers, such as, but not limited to cumene sulfonate, and/or addition of higher level of solvents such as polyols, some of which are discussed in the paragraphs below.

Method for Prediction of Clarity/Haziness of a Liquid Detergent Composition

The present invention includes a method for prediction of clarity/haziness of the finished liquid detergent composition. In this method, one can calculate $HI_C$, IS, and % total surfactant of the finished liquid detergent composition and calculate Formulation Tolerance (FT) as discussed above. If no performance enhancing materials are included in the finished liquid detergent composition, and FT is at least 33, preferably at least 40 the finished liquid detergent composition will have acceptable clarity. Addition of other performance enhancing materials (e.g. viscosity modifiers, polymers, or performance enhancing materials) may require the Formulation Tolerance to be greater than that without the performance enhancing materials. For example, if an alkoxylated polyethyleneimine polymer (PEI) is used as a performance enhancing material, the Formulation Tolerance must be at greater than 39, preferably without the use of co-solvents, hydrotropes and phase stabilizers. Examples of preferred compositions are shown in the Table 1. For comparison, examples of not-preferred compositions are shown in the Table 2.

TABLE 1

Examples of stable formulations* shown by weight
% by weight of the liquid detergent composition

| HI | IS | FT | % AES[1] | % LAS[2] | NI 23-9[3] | Citrate | Borax | Sodium Formate | % water |
|---|---|---|---|---|---|---|---|---|---|
| 9.89 | 1.24 | 79.81 | 3 | 2 | 4 | 1 | 1 | 1.6 | 74.93 |
| 9.11 | 1.46 | 81.08 | 4 | 4 | 4 | 1 | 1 | 1.6 | 71.37 |
| 8.68 | 1.79 | 82.49 | 6 | 6 | 4 | 1 | 1 | 1.6 | 66.63 |
| 9.89 | 1.78 | 55.52 | 3 | 2 | 4 | 2.5 | 1.4 | 1.6 | 73.03 |
| 9.11 | 2.04 | 58.15 | 4 | 4 | 4 | 2.5 | 1.4 | 1.6 | 69.47 |
| 8.68 | 2.42 | 61.06 | 6 | 6 | 4 | 2.5 | 1.4 | 1.6 | 64.73 |
| 9.79 | 2.01 | 73.18 | 8 | 2 | 4 | 2.5 | 1.4 | 1.6 | 68.03 |
| 8.54 | 1.28 | 66.88 | 4 | 3 | 2 | 1 | 1 | 1.6 | 74.93 |
| 8.21 | 1.42 | 63.61 | 4 | 4 | 2 | 1 | 1 | 1.6 | 73.37 |
| 7.96 | 1.74 | 68.81 | 6 | 6 | 2 | 1 | 1 | 1.6 | 68.63 |
| 8.54 | 1.48 | 57.74 | 4 | 3 | 2 | 1.5 | 1.4 | 1.6 | 74.03 |
| 8.21 | 1.80 | 50.12 | 4 | 4 | 2 | 2 | 1.4 | 1.6 | 71.97 |
| 7.96 | 2.34 | 50.98 | 6 | 6 | 2 | 2.5 | 1.4 | 1.6 | 66.73 |
| 9.14 | 1.95 | 60.94 | 8 | 2 | 2 | 2.5 | 1.4 | 1.6 | 70.03 |

TABLE 1-continued

| Examples of stable formulations* shown by weight % by weight of the liquid detergent composition | | | | | | | | | |
|---|---|---|---|---|---|---|---|---|---|
| HI | IS | FT | % AES[1] | % LAS[2] | NI 23-9[3] | Citrate | Borax | Sodium Formate | % water |
| 6.99 | 1.35 | 56.79 | 5 | 5 | 0 | 1 | 1 | 1.6 | 73.93 |
| 7.03 | 1.54 | 59.37 | 6 | 6 | 0 | 1 | 1 | 1.6 | 71.37 |
| 7.06 | 1.78 | 59.62 | 7 | 7 | 0 | 1 | 1 | 1.6 | 68.63 |
| 6.99 | 1.46 | 52.71 | 5 | 5 | 0 | 1.5 | 0.3 | 1.6 | 74.13 |
| 7.03 | 1.82 | 50.11 | 6 | 6 | 0 | 2 | 0.3 | 1.6 | 71.07 |
| 7.06 | 2.26 | 46.84 | 7 | 7 | 0 | 2.5 | 0.3 | 1.6 | 67.83 |
| 7.09 | 2.09 | 57.78 | 8 | 8 | 0 | 2.5 | 0.3 | 1.6 | 67.13 |
| 8.59 | 1.68 | 63.82 | 9 | 2 | 0.5 | 2.5 | 1 | 0.6 | 71.93 |
| 8.66 | 1.72 | 67.83 | 10 | 2 | 0.5 | 2.5 | 1 | 0.6 | 70.93 |
| 8.73 | 1.77 | 71.60 | 11 | 2 | 0.5 | 2.5 | 1 | 0.6 | 69.93 |
| 8.78 | 1.81 | 75.15 | 12 | 2 | 0.5 | 2.5 | 1 | 0.6 | 68.93 |
| 8.83 | 1.86 | 78.47 | 13 | 2 | 0.5 | 2.5 | 1 | 0.6 | 67.93 |
| 8.87 | 1.90 | 81.57 | 14 | 2 | 0.5 | 2.5 | 1 | 0.6 | 66.93 |
| 9.83 | 0.94 | 188.87 | 15 | 1 | 2 | 0 | 0.3 | 0 | 66.63 |
| 10.36 | 0.93 | 188.96 | 12 | 1 | 4 | 0 | 1 | 0 | 66.93 |
| 9.83 | 0.91 | 194.05 | 15 | 1 | 2 | 0 | 0 | 0 | 66.93 |
| 10.53 | 0.89 | 165.43 | 9 | 1 | 4 | 0 | 0 | 0.5 | 70.43 |
| 8.82 | 0.96 | 165.76 | 15 | 3 | 0 | 0 | 0 | 0 | 66.93 |
| 9.88 | 0.77 | 166.49 | 6 | 3 | 4 | 0 | 0 | 0 | 71.93 |
| 10.36 | 1.20 | 146.32 | 12 | 1 | 4 | 1 | 0 | 0 | 66.93 |
| 10.53 | 1.12 | 131.26 | 9 | 1 | 4 | 1 | 0 | 0 | 69.93 |
| 9.83 | 1.21 | 130.04 | 9 | 3 | 4 | 1 | 0.3 | 0 | 67.63 |
| 9.83 | 1.30 | 121.27 | 9 | 3 | 4 | 1 | 0 | 0.5 | 67.43 |
| 11.23 | 0.77 | 117.10 | 3 | 1 | 4 | 0 | 0 | 0.5 | 76.43 |
| 10.53 | 1.26 | 117.15 | 9 | 1 | 4 | 1 | 0.3 | 0.5 | 69.13 |
| 10.78 | 1.03 | 114.85 | 6 | 1 | 4 | 0 | 0 | 1.5 | 72.43 |
| 9.23 | 1.12 | 114.90 | 9 | 3 | 2 | 0 | 1 | 1 | 68.93 |
| 10.53 | 1.92 | 76.58 | 9 | 1 | 4 | 3 | 1 | 0 | 66.93 |
| 9.83 | 2.31 | 76.60 | 15 | 1 | 2 | 2 | 1.5 | 2 | 61.43 |
| 9.87 | 1.93 | 76.61 | 12 | 1 | 2 | 3 | 0.3 | 0 | 66.63 |
| 8.73 | 1.93 | 76.67 | 6 | 7 | 4 | 2 | 1 | 1 | 63.93 |
| 8.66 | 1.72 | 75.65 | 12 | 3 | 0 | 1 | 0.3 | 2 | 66.63 |
| 8.02 | 1.59 | 75.65 | 6 | 7 | 2 | 2 | 0.3 | 0 | 67.63 |
| 9.94 | 1.58 | 75.66 | 9 | 1 | 2 | 2 | 1.5 | 0 | 69.43 |
| 6.12 | 0.97 | 75.66 | 3 | 9 | 0 | 0 | 0.3 | 0.5 | 72.13 |

*compositions include, but are not limited to these levels and types of components; and may additionally include optional performance enhancing materials, such as, but not limited to other co-surfactants, fatty acids, appropriate levels of enzymes, solvents, neutralizing agents, viscosity control agents other than that of salt modifiers and the like. Changes in the type and chainlengths of various surfactants can be made as well, however if this is the case, these structural changes must be regarded in the calculation of HI.

[1] $C_{10}$-$C_{18}$ alkyl ethoxy sulfate

[2] $C_9$-$C_{15}$ alkyl benzene sulfonate

[3] $C_{12}$-$C_{13}$ ethoxylated ($EO_9$) alcohol

TABLE 2

| Examples of non-preferred hazy formulations shown by weight % of the liquid detergent composition | | | | | | | | | |
|---|---|---|---|---|---|---|---|---|---|
| HI | IS | FT | % AES[1] | % LAS[2] | NI 23-9[3] | Citrate | Borax | Sodium Formate | % water |
| 6.70 | 1.94 | 27.61 | 3 | 5 | 0 | 2 | 1.5 | 2 | 71.43 |
| 8.96 | 2.20 | 32.60 | 3 | 3 | 2 | 3 | 1 | 2 | 70.93 |
| 8.05 | 2.21 | 32.78 | 6 | 3 | 0 | 3 | 1.5 | 1.5 | 69.93 |
| 8.96 | 2.02 | 35.51 | 3 | 3 | 2 | 3 | 1.5 | 1 | 71.43 |
| 8.16 | 2.29 | 35.63 | 3 | 5 | 2 | 3 | 1 | 2 | 68.93 |
| 6.70 | 1.50 | 35.64 | 3 | 5 | 0 | 2 | 1.5 | 0 | 73.43 |
| 7.10 | 2.53 | 36.51 | 6 | 7 | 0 | 3 | 1.5 | 2 | 65.43 |
| 8.05 | 1.98 | 36.56 | 6 | 3 | 0 | 3 | 0.3 | 1 | 71.63 |
| 7.49 | 2.25 | 36.57 | 6 | 5 | 0 | 3 | 1 | 1.5 | 68.43 |
| 8.05 | 1.98 | 36.59 | 6 | 3 | 0 | 3 | 1.5 | 0.5 | 70.93 |
| 7.10 | 2.37 | 38.99 | 6 | 7 | 0 | 3 | 0 | 2 | 66.93 |

[1] $C_{10}$-$C_{18}$ alkyl ethoxy sulfate

[2] $C_9$-$C_{15}$ alkyl benzene sulfonate

[3] $C_{12}$-$C_{13}$ ethoxylated ($EO_9$) alcohol

Liquid Detergent Composition

As stated above, the liquid detergent composition should have a Formulation Tolerance greater than 33, more preferably greater than 35, more preferably greater than 39, even more preferably greater than 40, and even more preferably greater than 45. The liquid detergent composition comprises primarily of a surfactant system, a formulation salt modifier and a liquid carrier to give the desired Formulation Tolerance, with optional performance enhancing agents such as soil suspending agents, soil release agents, grease and oil cleaning polymers (e.g., alkoxylated polyethyleneimine polymers), and enzymes; and optional adjunct components such as perfumes, dyes and light dispersing agents.

Surfactant System

The liquid detergent composition of the present invention comprises a total surfactant system from about 8 to about 18 weight %, by weight of the composition.

The surfactant system may further comprise from about 0.01% to about 9% by weight of the composition of a $C_{8-15}$ alkyl benzene sulfonate surfactant and from 0% to about 5% by weight of a nonionic surfactant. Other surfactants selected from anionic surfactants, other nonionic co-surfactants, an anionic co-surfactant, a cationic co-surfactant, and any mixture thereof may also be selection. Exact surfactant ratios can be chosen depending on the requirements of HI and ionic strength as illustrated in paragraphs above.

Anionic Surfactant

In one embodiment the composition of the present invention comprises a surfactant system comprising an anionic surfactant of $C_9$-$C_{18}$ alkyl ethoxy sulfates ($AE_xS$) wherein x, the average degree of ethoxylation, is from about 1 to about 30, more preferably from about 1 to about 10; and even more preferably from about 1 to about 5. The alkyl ethoxy sulfate surfactant may be present in the composition from about 5% to about 17.99%; preferably from about 5% to 16% by weight of the composition.

In an embodiment the surfactant system is $AE_xS$ rich. By "$AE_xS$-rich" it is intended to mean that $AE_xS$ will be present in a greater weight % amount to any present co-surfactant. Preferably $AE_xS$ is present in a weight % ratio from about 1:1 to about 100:1 or from 1.1:50:1 or from 1.2:1 to 10:1 with any other co-surfactant in the mixture.

Anionic Co-Surfactants

Nonlimiting examples of anionic co-surfactants useful herein include: $C_{10}$-$C_{20}$ primary, branched chain and random alkyl sulfates (AS) and $C_{10}$-$C_{18}$ secondary (2,3) alkyl sulfates; $C_{10}$-$C_{18}$ alkyl alkoxy carboxylates comprising 1-5 ethoxy units; methyl ester sulfonate (MES); and alpha-olefin sulfonate (AOS).

The surfactant system may contain some anionic co-surfactants from about 0.01% to about 12% by weight, more preferably from about 0.01% to about 10% by weight, even more preferably from about 0.01% to about 9% by weight.

Nonionic Surfactant and Nonionic Co-Surfactants

Non-limiting examples of a nonionic surfactant includes: $C_{12}$-$C_{18}$ alkyl ethoxylates, such as, NEODOL® nonionic surfactants from Shell and LUTENSOL® nonionic surfactants from BASF; $C_6$-$C_{12}$ alkyl phenol alkoxylates wherein the alkoxylate units are a mixture of ethyleneoxy and propyleneoxy units; $C_{12}$-$C_{18}$ alcohol and $C_6$-$C_{12}$ alkyl phenol condensates with ethylene oxide/propylene oxide block alkyl polyamine ethoxylates such as PLURONIC® from BASF; $C_{14}$-$C_{22}$ mid-chain branched alcohols, BA, as discussed in U.S. Pat. No. 6,150,322; $C_{14}$-$C_{22}$ mid-chain branched alkyl alkoxylates, $BAE_x$, wherein x is from 1-30, as discussed in U.S. Pat. No. 6,153,577, U.S. Pat. No. 6,020,303 and U.S. Pat. No. 6,093,856; Alkylpolysaccharides as discussed in U.S. Pat. No. 4,565,647 Llenado, issued Jan. 26, 1986; specifically alkylpolyglycosides as discussed in U.S. Pat. No. 4,483,780 and U.S. Pat. No. 4,483,779; Polyhydroxy fatty acid amides (GS-base) as discussed in U.S. Pat. No. 5,332,528; and ether capped poly(oxyalkylated) alcohol surfactants as discussed in U.S. Pat. No. 6,482,994 and WO 01/42408.

Non-limiting examples of semi-polar nonionic co-surfactants include: water-soluble amine oxides containing one alkyl moiety of from about 10 to about 18 carbon atoms and 2 moieties selected from the group consisting of alkyl moieties and hydroxyalkyl moieties containing from about 1 to about 3 carbon atoms; water-soluble phosphine oxides containing one alkyl moiety of from about 10 to about 18 carbon atoms and 2 moieties selected from the group consisting of alkyl moieties and hydroxyalkyl moieties containing from about 1 to about 3 carbon atoms; and water-soluble sulfoxides containing one alkyl moiety of from about 10 to about 18 carbon atoms and a moiety selected from the group consisting of alkyl moieties and hydroxyalkyl moieties of from about 1 to about 3 carbon atoms. See WO 01/32816, U.S. Pat. No. 4,681,704, and U.S. Pat. No. 4,133,779.

In one embodiment, the surfactant system comprises a total of less than 5% by weight (from 0% to about 5%), of a nonionic surfactant selected from $C_{12}$-$C_{18}$ alkyl ethoxylates having an average degree of ethoxylation from 0.1 to 15.

Cationic Co-Surfactants

Non-limiting examples of cationic co-surfactants include: the quaternary ammonium surfactants, which can have up to 26 carbon atoms include: alkoxylate quaternary ammonium (AQA) surfactants as discussed in U.S. Pat. No. 6,136,769; dimethyl hydroxyethyl quaternary ammonium as discussed in U.S. Pat. No. 6,004,922; dimethyl hydroxyethyl lauryl ammonium chloride; polyamine cationic surfactants as discussed in WO 98/35002, WO 98/35003, WO 98/35004, WO 98/35005, and WO 98/35006; cationic ester surfactants as discussed in U.S. Pat. Nos. 4,228,042, 4,239,660 4,260,529 and U.S. Pat. No. 6,022,844; and amino surfactants as discussed in U.S. Pat. No. 6,221,825 and WO 00/47708, specifically amido propyldimethyl amine (APA). In one embodiment, the surfactant system comprises a total of less than 3% by weight (from 0% to about 3%), of a cationic surfactant.

Formulation Salt Modifier

The detergent composition of the present invention comprises from about 0.01% to about 5%; preferably from about 0.01% to about 4%; more preferably from about 0.01% to about 3% by weight of the composition of a formulation salt modifier.

The formulation salt modifiers may be selected from water soluble alkali and alkali earth metal salts, such as lithium, sodium, potassium, magnesium or calcium salts such as sulfate, formate, acetate, chloride, carbonate, bicarbonate and oxides. Preferably, the formulation salt modifier is selected from sodium formate, sodium sulfate, sodium chloride, sodium acetate, sodium carbonate, sodium bicarbonate, or mixtures of thereof.

Liquid Carrier

The liquid detergent compositions according to the present invention also contain a liquid carrier. Generally the amount of the liquid carrier employed in the compositions herein will be relatively large and comprise the balance of the composition, but can comprise from about 20 wt % to about 90 wt % by weight of the detergent composition. Preferably, the compositions of the present invention comprise from about 40% to about 90%, more preferably from about 50 to about 90% of a liquid carrier.

The most cost effective type of liquid carrier is, of course, water itself and the liquid carrier will generally be mostly, if not completely, comprised of water. However, other liquid carriers such as co-solvents, hydrotropes and phase stabilizers may be included in the liquid carrier as required for desired viscosity, enzyme stability and favorable processing. Materials of this type include $C_1$-$C_3$ lower alkanols such as methanol, ethanol and/or propanol, glycerol, other alkanols, diols, other polyols, ethers, amines, and $C_1$-$C_3$ alkanolamines such as mono-, di- and triethanolamines. If utilized, phase stabilizers/co-solvents can comprise from 0% to about 30%, more preferably 0% to about 20%, more preferably 0.1% to about 15%, and even more preferably from about 1% to about 10% by weight of the composition.

In one embodiment the liquid detergent composition should be essentially free of cumene sulfonate as rheology and stability modifier. As used herein "essentially free of" mean that cumene sulfonate should not be included or should only be present in trace amounts less than 1% by weight of the composition. Preferred level of borax, generally utilized as an enzyme stabilizer, should be from 0 to about 3%, more preferably from about 0.1 to about 2%, and even more preferably from about 0.3 to about 1.5%.

Optional Performance Enhancing Agents and Optional Adjunct Components

The detergent compositions of the present invention can also include any number of additional optional agents and components. These include conventional laundry detergent composition agents and components such as detersive enzymes, enzyme stabilizers (such as glycerol, propylene glycol, boric acid and/or borax), builders, suds suppressors, soil suspending agents, soil release agents, pH adjusting agents, chelating agents, smectite clays, dye transfer inhibiting agents, other fabric care benefit agents, optical brighteners, perfumes and coloring agents (dyes). The various optional detergent composition agents and components, if present in the compositions herein, should be utilized at concentrations conventionally employed to bring about their desired contribution to the composition or the laundering operation. Frequently, the total amount of such optional detergent composition agents and components can range from about 0.01% to about 50%, more preferably from about 0.01% to about 40%, and preferably from about 0.1% to about 30% by weight of the composition.

Enzymes

Enzymes can be included in effective amounts in the formulations herein for a wide variety of fabric laundering purposes, including removal of protein-based, carbohydrate-based, or triglyceride-based stains, for example, and/or for fabric restoration. As used herein, an "effective amount" is an amount of additional enzyme to achieve the desired removal of the indicated stain or fabric restoration indicated above.

Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, amylases, or combinations thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on.

Enzyme Stabilizer

If an enzyme or enzymes are included in the compositions of the present invention, it is preferred that the composition also contain an enzyme stabilizer. Enzymes can be stabilized using any known stabilizer system like calcium and/or magnesium compounds, boron compounds and substituted boric acids, aromatic borate esters, peptides and peptide derivatives, polyols, low molecular weight carboxylates, relatively hydrophobic organic compounds (i.e., certain esters, diakyl glycol ethers, alcohols or alcohol alkoxylates), alkyl ether carboxylate in addition to a calcium ion source, benzamidine hypochlorite, lower aliphatic alcohols and carboxylic acids, N,N-bis(carboxymethyl) serine salts; (meth)acrylic acid-(meth)acrylic acid ester copolymer and PEG; lignin compounds, polyamide oligomer, glycolic acid or its salts; poly hexa methylene biguanide or N,N-bis-3-amino-propyl-dodecyl amine or salt; and mixtures thereof. See also U.S. Pat. No. 3,600,319, Gedge, et al., EP 0 199 405 A, Venegas, U.S. Pat. No. 3,519,570 and U.S. Pat. No. 4,537,706 (borate species). Should an enzyme stabilizer be able to be a liquid carrier, such as borax, levels utilized should reflect that discussed in the liquid carrier section above.

Organic Detergent Builders

The detergent compositions herein may also optionally contain an organic detergent builder material. Examples include the alkali metal, citrates, succinates, malonates, carboxymethyl succinates, carboxylates, polycarboxylates and polyacetyl carboxylates. Specific examples include sodium, potassium and lithium salts of oxydisuccinic acid, mellitic acid, benzene polycarboxylic acids, $C_{10}$-$C_{22}$ fatty acids and citric acid. Other examples are DEQUEST® organic phosphonate type sequestering agents sold by Monsanto and alkanehydroxy phosphonates. Citrate salts and $C_{12}$-$C_{18}$ fatty acid soaps are highly preferred.

Other organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the SOKALAN® trademark, copolymers of polyacrylic acid with either ionic and/or hydrophobic materials. It is important to note that one has to employ care in the choice of such polymeric materials to formulate into liquid detergent composition with desired % T. This may be achieved by appropriate molecular optimization of such materials, optimization and definition of Formulation Tolerance required for these materials to form clear and transparent formulations, and/or addition of such materials at appropriate level to formulate into clear and transparent liquid detergent composition.

If utilized, the composition may comprise up to 30%, preferably from 0% to about 20%, more preferably from about 0.01% to about 10%, by weight of the composition, of the organic builder materials.

pH Control Agents

The detergent compositions herein may also optionally contain low levels of materials which serve to adjust or maintain the pH of the detergent compositions herein at optimum levels. The pH of the compositions herein should range from about 4 to about 11, more preferably from about 5 to about 10. If enzymes are present in the formulation than the pH of the composition herein should range from about 6 to about 9, more preferably from about 6.5 to about 8.9, and even more preferably from about 6.8 to about 8.8. Materials such as NaOH can be added to alter composition pH, if necessary.

Performance Enhancing Polymers Performance Enhancing Polymers

The liquid detergent compositions of the present invention may further comprise a polymer system having one or more performance enhancing polymers. Soil suspending agents may be those commonly known in the art such as block polyesters according to U.S. Pat. No. 4,702,857 Gosselink, issued Oct. 27, 1987 and sulfonated linear terephthalate ester oligomers according to U.S. Pat. No. 4,968,451, Scheibel et al., issued Nov. 6, 1990, modified polyethyleneimine polymers such as those described in U.S. Pat. No. 5,565,145 and those further described below.

Soil release agents may be those commonly known in the art such as ethoxylated tetraethylene pentaimine ($EO_{15-18}$) according to U.S. Pat. No. 4,597,898 Vander Meer, issued Jul. 1, 1986, and ethoxylated hexamethylene diamine available under the tradename LUTENSIT® from BASF and such as those described in WO 01/05874.

The performance enhancing polymers may comprise from 0% to about 6%, more preferably from 0% to about 4%, and even more preferably from about 0.01% to about 2.5% by weight of the liquid detergent composition.

Alkoxylated Polyethyleneimine Polymer

The present composition may comprise from about 0.01 wt % to about 10 wt %, preferably from about 0.1 wt % to about 5 wt %, more preferable from about 0.2% to about 3% by weight of the composition of an alkoxylated polyethyleneimine polymer.

The alkoxylated polyethyleneimine polymer of the present composition has a polyethyleneimine backbone having from about 400 to about 10000 weight average molecular weight, preferably from about 600 to about 7000 weight average molecular weight, alternatively from about 3000 to about 7000 weight average molecular weight.

The alkoxylation of the polyethyleneimine backbone includes: (1) one or two alkoxylation modifications per nitrogen atom, dependent on whether the modification occurs at a internal nitrogen atom or at an terminal nitrogen atom, in the polyethyleneimine backbone, the alkoxylation modification consisting of the replacement of a hydrogen atom on by a polyalkoxylene chain having an average of about 1 to about 40 alkoxy moieties per modification, wherein the terminal alkoxy moiety of the alkoxylation modification is capped with hydrogen, a $C_1$-$C_4$ alkyl or mixtures thereof; (2) a substitution of one $C_1$-$C_4$ alkyl moiety and one or two alkoxylation modifications per nitrogen atom, dependent on whether the substitution occurs at a internal nitrogen atom or at an terminal nitrogen atom, in the polyethyleneimine backbone, the alkoxylation modification consisting of the replacement of a hydrogen atom by a polyalkoxylene chain having an average of about 1 to about 40 alkoxy moieties per modification wherein the terminal alkoxy moiety is capped with hydrogen, a $C_1$-$C_4$ alkyl or mixtures thereof; or (3) a combination thereof.

For example, but not limited to, below is shown possible modifications to terminal nitrogen atoms in the polyethyleneimine backbone where R represents an ethylene spacer and E represents a $C_1$-$C_4$ alkyl moiety and $X^-$ represents a suitable water soluble counterion.

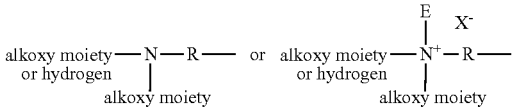

Also, for example, but not limited to, below is shown possible modifications to internal nitrogen atoms in the polyethyleneimine backbone where R represents an ethylene spacer and E represents a $C_1$-$C_4$ alkyl moiety and X− represents a suitable water soluble counterion.

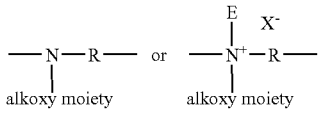

The alkoxylation modification of the polyethyleneimine backbone consists of the replacement of a hydrogen atom by a polyalkoxylene chain having an average of about 1 to about 40 alkoxy moieties, preferably from about 5 to about 20 alkoxy moieties. The alkoxy moieties are selected from ethoxy (EO), 1,2-propoxy (1,2-PO), 1,3-propoxy (1,3-PO), butoxy (BO), and combinations thereof. Preferably, the polyalkoxylene chain is selected from ethoxy moieties and ethoxy/propoxy block moieties. More preferably, the polyalkoxylene chain is ethoxy moieties in an average degree of from about 5 to about 15 and the polyalkoxylene chain is ethoxy/propoxy block moieties having an average degree of ethoxylation from about 5 to about 15 and an average degree of propoxylation from about 1 to about 16. Most preferable the polyalkoxylene chain is the ethoxy/propoxy block moieties wherein the propoxy moiety block is the terminal alkoxy moiety block.

The modification may result in permanent quaternization of the polyethyleneimine backbone nitrogen atoms. The degree of permanent quaternization may be from 0% to about 30% of the polyethyleneimine backbone nitrogen atoms. It is preferred to have less than 30% of the polyethyleneimine backbone nitrogen atoms permanently quaternized.

A preferred modified polyethyleneimine has the general structure of formula (I):

formula (I)

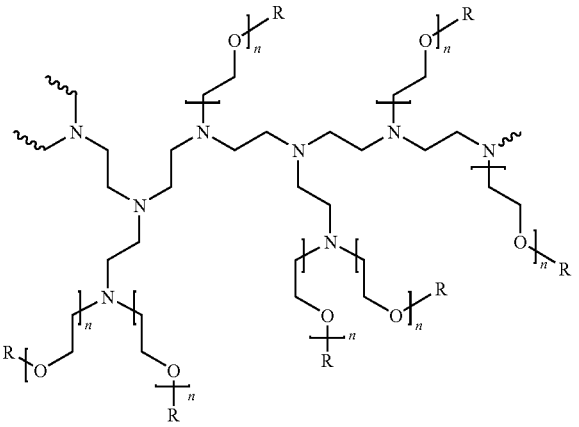

wherein the polyethyleneimine backbone has a weight average molecular weight of 5000, n of formula (I) has an average of 7 and R of formula (I) is selected from hydrogen, a $C_1$-$C_4$ alkyl and mixtures thereof.

Another preferred polyethyleneimine has the general structure of formula (II):

formula (II)

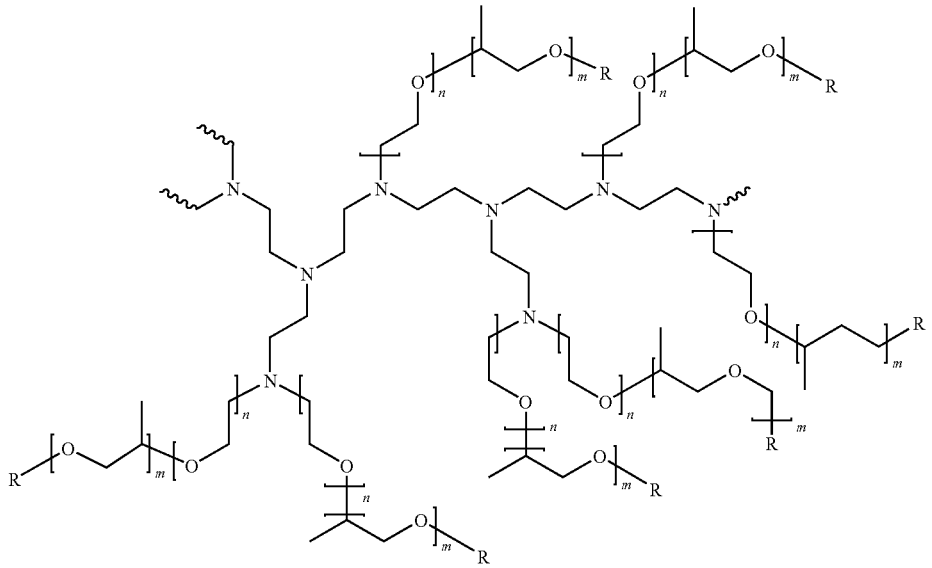

wherein the polyethyleneimine backbone has a weight average molecular weight of 5000, n of formula (II) has an average of 10, m of formula (II) has an average of 7 and R of formula (II) is selected from hydrogen, a $C_1$-$C_4$ alkyl and mixtures thereof. The degree of permanent quaternization of formula (II) may be from 0% to about 22% of the polyethyleneimine backbone nitrogen atoms.

These polyamines can be prepared, for example, by polymerizing ethyleneimine in the presence of a catalyst such as carbon dioxide, sodium bisulfite, sulfuric acid, hydrogen peroxide, hydrochloric acid, acetic acid, and the like. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951.

Example 1

Polyethyleneimine (Backbone Molecular Weight 5000) Hereinafter PEI 5000 with 7 Ethoxy Moieties (EO) Per Nitrogen of the Polyethyleneiminie Backbone (NH)

a) Treatment of PEI 5000 with 1 EO/NH

Heat to 80° C. in a 2 L reactor 900 g of a 50 wt % aqueous solution of PEI 5000 (backbone molecular weight 5000) and strip with nitrogen thrice (until a pressure of 500 kPa (5 bar) is obtained). Increase the temperature to 90° C. and add 461 g ethylene oxide until pressure rises to 500 kPa (5 bar). Remove the volatile components after 2 hours by stripping with nitrogen at 80° C. or vacuum of 50 kPa (500 mbar) at 80° C. Collect 1345 g of a 68% aqueous solution, which contains PEI 5000 with 1 EO/NH b) Alkoxylation in the Presence of a Solvent Treat in a 2 l reactor 362 g of a 68.5% aqueous solution from step (a) with 31 g of 40% aqueous solution of potassium hydroxide and 300 g xylene and strip with nitrogen thrice (until a pressure of 500 kPa (5 bar) is obtained). Remove water during a 4 hour time period at 170° C. (under ascription of solvent). Add 753 g ethylene oxide at 120° C. until pressure of 300 kPa (3 bar) is obtained. Stir for 3 hours at 120° C. Remove the solvent from the compound and strip with a water steam at 120° C. for 3 hours. Collect 1000 g of a bright brownish viscous liquid (amine: 2.5448 mmol KOH/g; pH value 1% ig in water 11.2), which is the desired product (PEI 5000—7 EO/NH).

Example 2

Polyethyleneimine (Backbone Molecular Weight 5000) Hereinafter PEI 5000 with 10 Exthoxy Moieties (EO) and 7 Propoxy Moieties (PO) Per Nitrogen of the Polyethyleneiminie Backbone (NH)

a) Treatment of PEI 5000 with 1 EO/NH as in Example 1.

b) Alkoxylation

Treat in a 2 l reactor 163 g of a 68.4% the aqueous solution from step (a) with 13.9 g of 40% an aqueous solution of potassium hydroxide, heat to 70° C. and strip with nitrogen thrice (until a pressure of 500 kPa (5 bar) is obtained). Remove water during a 4 hour time period at 120° C. and vacuum of 1 kPa (10 mbar). Add 506 g ethylene oxide at 120° C. until pressure of 800 kPa (8 bar) is obtained. Stir for 4 hours at 120° C. Strip with nitrogen 120° C. Add 519 g propylene oxide at 120° C. until pressure of 800 kPa (8 bar) is obtained. Stir for 4 hours at 102° C. Remove volatile components by stripping with nitrogen at 80° C. or vacuum of 50 kPa (500 mbar) at 80° C. Collect 1178 g of a bright brownish viscous liquid (amine titer: 0.9276 mmol KOH/g; pH value 1% ig in water 10.67), which is the desired product (PEI 5000—10 EO/NH—7 PO/NH).

Or

Alternative b) Alkoxylation in the Presence of a Solvent

Treat in a 2 l reactor 137 g of a 68.7% the aqueous solution from (a) with 11.8 g of 40% aqueous solution of potassium hydroxide and 300 g xylene and strip with nitrogen thrice (until pressure of 500 kPa (5 bar)). Remove the water present over the next 4 hours while maintaining a temperature of 170° C. (under ascription of solvent). Add 428 g of ethylene oxide at 120° C. until pressure of 300 kPa (3 bar) is obtained and stir for 2 hours at 120° C. Strip with nitrogen at 120° C. Add 439 g propylene oxide at 120° C. until pressure of 300 kPa (3 bar) is obtained. Stir for 3 hours at 120° C. Remove the solvent from the compound and strip with a water steam at 120° C. for 3 hours. Collect 956 g of a bright brownish viscous liquid (amine titer: 0.9672 mmol KOH/g; pH value 1% ig in water 10.69), which is the desired product (PEI 5000—10 EO/NH—7 PO/NH).

Example 3

Polyethyleneimine (Backbone Molecular Weight 5000) Hereinafter PEI5000 with 10 Exthoxy Moieties (EO) and 7 Propoxy Moieties (PO) Per Nitrogen of the Polyethyleneiminie Backbone (NH) with 22% Quaternization Prepare PEI 5000 EO10 PO7 as Shown in the Example 2 a) Quaternization 300 g of PEI5000—10 EO/NH—7 PO/NH (example 2) under nitrogen atmosphere were heated to 60° C. Subsequent 7.3 g dimethyl sulfate were dropwise added. Temperature rose to 70° C. and the mixture was stirred for 3 h. Reduction of amine titer (from 0.9672 mmol/g to 0.7514 mmol/g) showed a quaternation of 22% of N. 307 g of a brownish, viscous liquid are received, which is PEI 5000—(10 EO—7 PO)/NH—22% quatted.

Example 4

Polyethyleneimine (Backbone Molecular Weight 600) Hereinafter PEI600 with 10 Exthoxy Moieties (EO) and 7 Propoxy Moieties (PO) Per Nitrogen of the Polyethyleneiminie Backbone (NH)

a) Treatment of PEI 600 with 1 EO/NH

In a 2 l reactor 516 g of polyethylene imine 600 (molecular weight 600 g/mol) and 10.3 g water were stripped with nitrogen thrice (until pressure of 5 bar) and heated to 90° C. At 90° C. 528 g ethylene oxide were added. After 1 h stifling at 90° C. 1050 g of a liquid are received. Volatile components are removed by stripping with nitrogen or vacuum of 10 mbar at 90° C. The liquid contains PEI 600 with 1 EO/NH.

b) Alkoxylation

In a 2 l reactor 86 g of a liquid from a) were treated with 10.8 g of 40% aqueous solution of KOH, heated to 80° C. and stripped with nitrogen thrice (until pressure of 5 bar). Water was removed during 2.5 h at 120° C. and vacuum of 10 mbar. Subsequent reactor was flushed with nitrogen and 384 g ethylene oxide were added at 120° C. and 2 h stirred at this temperature afterwards. Afterwards at 120° C. 393 g propylene oxide were added at 120° C. and 2 h stirred at this temperature. Volatile components are removed by stripping with nitrogen or vacuum of 500 mbar at 80° C. 865 g of a bright brownish viscous liquid are received (amine titer: 1.0137 mmol/g; pH value 1% ig in water 11.15), which is the desired product (PEI 600—10 EO/NH—7 PO/NH).

Example 5

Polyethyleneimine (Backbone Molecular Weight 5000) Hereinafter PEI 5000 with 9.9 Exthoxy Moieties (EO) and 15.5 Propoxy Moieties (PO) Per Nitrogen of the Polyethyleneiminie Backbone (NH)

a) Treatment of PEI 5000 with 1 EO/NH as in Example 1 b) Alkoxylation

Treat in a 2 L reactor 321 g of a 69.2% aqueous solution from (a) with 28 g of 40% aqueous solution of potassium hydroxide, heat to 80° C. and strip with nitrogen thrice (until a pressure of 500 kPa (5 bar) is obtained). Remove water during the next 3 hours while maintaining a temperature of 120° C. and vacuum of 1 kPa (10 mbar). Add 1020 g ethylene oxide at 120° C. until pressure of 800 kPa (8 bar) is obtained. Stir for 4 hours at 120° C. Remove the volatile components by stripping with nitrogen at 80° C. or under a vacuum of 50 kPa (500 mbar) at 80° C. Collect 1240 g of a brownish viscous liquid, which contains PEI 5000 with 9.9 EO/NH (amine titer: 1.7763 mmol KOH/g; pH value 1% ig in water 11.3). Strip with nitrogen (until pressure of 500 kPa (5 bar) is obtained) 156 g of PEI 5000 with 9.9 EO/NH were heated to 120° C. Add 284 g (metering precision+/−15 g) propylene oxide at 120° C. until pressure of 800 kPa (8 bar) is obtained. Stir for 4 hours at 120° C. Remove volatile components by stripping with nitrogen at 80° C. or under a vacuum of 50 kPa (500 mbar) at 80° C. Collect 450 g of a bright brownish viscous liquid (amine titer: 0.6545 mmol KOH/g; pH value 1% ig in water 11.05), which is the desired product (PEI 5000 —9.9 EO/NH—15.5 PO/NH).

Composition Form, Preparation and Use

The liquid detergent compositions herein can be prepared by combining the components thereof in any convenient order and by mixing, e.g., agitating, the resulting component combination to form the phase stable liquid detergent compositions. In a preferred process, a liquid matrix is formed containing at least a major proportion, and preferably substantially all, of the liquid components, e.g., the surfactant, aqueous liquid carrier and any other optional liquid components, being thoroughly admixed by imparting shear agitation to this liquid matrix. For example, rapid stirring with a mechanical stirrer may usefully be employed, such as agitators and propeller that use axial and/or radial motion for good top to bottom turnover. Jet mixing may also be employed.

While shear agitation is maintained, the addition of any remaining non-liquid components can be added to the liquid matrix. Agitation of the liquid matrix is continued, and if necessary, can be increased to form a solution or a uniform dispersion of insoluble solid phase particulates within the liquid phase as long as the resulting liquid detergent composition will have desired transparency as discussed above. Preferably optional enzymes and/or enzyme prills are added last in liquid form into the liquid matrix, wherein the liquid matrix temperature is below 60° C., preferably below 50° C., and even more preferably below 42° C.

As a variation of the composition preparation procedure hereinbefore described, pre-mixing one or more of the non-liquid, or solid components as a solution or slurry of particles with a minor portion of one or more of the liquid components may then be added to the liquid matrix to form a mixture.

After addition of all of the composition components, agitation of the mixture is continued for a period of time sufficient to form a composition having the requisite viscosity and phase stability characteristics. The finished liquid detergent composition should have the transparency as discussed above with a viscosity of about 100 to about 800 cps, more preferably from about 150 to about 600 cps, and even more preferably from about 200 to about 500 cps and even more preferable from about 200 to about 400 cps, and stable for long periods of time, about 7 to 240 days.

For measurement of viscosity of finished liquid detergent composition any commercial viscometer can be used. In the presented application, Brookfield Viscometer LVDVII+ was used for testing with Spindle 31, at 60 rpm while the test solution viscosity was read at 21.1° C. All recommendations for optimal instrumental performance of the manufacturer were employed during measurement for gathering of appropriate readings. Care was taken to avoid air bubbles under the spindle. Viscosity readings were recorded in centipoises (cps).

The preferred pH of finished liquid detergent composition is 4-10, more preferably 5-9, and more preferably 7.8-8.8, more preferably 8.1-8.5. Measurement of pH of finished liquid detergent composition is made on 10% w/w using soft water to dilute. For example, 5 g of finished liquid detergent composition is diluted by 45 g of deionized water. Any commercial pH meter and pH electrode can be employed from pH measurement using recommendation of manufacturer for appropriate maintenance and calibration.

Usually preparation of batches of liquid detergent compositions is based on weight percentages of combinations of components that include surfactants, builders, stabilizers, performance enhancing additives and aesthetic enhancers. However, other convenient addition such as molar percentages, molar amounts, mass amounts, and the like can be also employed. Amount and order of addition of these raw materials is important, and it can affect material processing, viscosity, % transmittance, and finished product stability.

The most convenient order of addition of liquid detergent composition usually must be determined empirically to yield desired outcomes. For example, 2-8 kg batches can be made containing 6.22% less water than final water content. This initial compositional "hole" is left for later addition of a viscosity salt modifier. Usually desired amounts of $AE_xS$ surfactant is added to a 2 gal container followed by caustic ingredients and some stabilizers. After these ingredients are added, agitation begins using a pitched blade impeller. Speed of the impeller was adjusted so that the components have good mixing without pulling too much vortex and entraining air into the liquid matrix (RPM 100-400). Use a 10 cm impeller diameter with a geometric ratio D/T=0.4. Next add the desired amount of LAS to the container while continuing to agitate. Add acids and builders which increased the heat load of the liquid matrix. Keep the temperature of the liquid matrix below 54° C. by adding small amount of water. Next, add a performance enhancing additive, such as the formula (II) PEI 5000 EO7PO10 polymer to the liquid matrix, and add any remaining water. Measure a portion of product for pH at a 10% w/w aqueous solution. Make adjustments with either NaOH or citric acid to keep the pH within the batch limits (indicated above). When the liquid matrix temperature reaches below 32° F., add the desired enzymes to form a liquid detergent composition. Add a viscosity salt modifier such as sodium formate solution (30%) to the liquid detergent composition to yield appropriate viscosity and % T.

Another way to prepare said composition is to employ continuous line making process in the part and/or throughout the entire preparation process. In this case stirring is employed by for example, but not limited to, laminar flow static mixers, which use elements to provide re-orientation of the product by stretching, folding and cutting the fluid. Turbulent flow blending can also be utilized by the action of wakes, eddies, and vortices in the liquid matrix and liquid detergent composition.

The compositions of this invention, prepared as hereinbefore described, can be used to form aqueous washing solutions for use in the laundering of fabrics. Generally, an effective amount of such compositions is added to fabric surfaces directly and/or to water, preferably in a conventional fabric laundering automatic washing machine, to form such aqueous laundering solutions. The aqueous washing solution so formed is then contacted, preferably under agitation, with the fabrics to be laundered therewith.

An effective amount of the liquid detergent compositions herein added fabric is from 0.5 mL to 10 mL of the composition. An effective amount of the liquid detergent compositions herein added to water to form aqueous laundering solutions can comprise amounts sufficient to form from about 500 to 7,000 ppm of composition in aqueous washing solution. More preferably, from about 1,000 to 3,000 ppm of the detergent compositions herein will be provided in aqueous washing solution.

The liquid detergent compositions herein may be provided in a multiple use bottle or may be provided to consumers in a number of unit dose packages. Unit dose packages useful herein include those known in the art and include those that are water soluble, water insoluble, water permeable, and mixtures thereof.

TABLE 3

| | Formulations | | | | | |
|---|---|---|---|---|---|---|
| Ingredient (assuming 100% activity) | weight % | weight % | weight % | weight % | weight % | weight % |
| Formulation Tolerance | >40 | >40 | >40 | 53.21 | 52.65 | 52.65 |
| AES[1] | 5-18 | 5-18 | 5-18 | 11 | 10.5 | 10.5 |
| LAS[2] | 0.01-10 | 0.01-10 | 0.01-10 | 4 | 2.86 | 2.86 |
| NI 23-9[3] | 0-5 | 0-5 | 0-5 | 0.4 | 0.4 | 0.4 |
| $C_{12-14}$ dimethyl Amine Oxide | 0-2 | 0-2 | 0-2 | 0.3 | 0.26 | 0.26 |
| Citric Acid | 0-3 | 0-3 | 0-3 | 2.5 | 2.3 | 2.3 |
| $C_{12-18}$ Fatty Acids | 0-4 | 0-4 | 0-4 | 0.8 | 0.8 | 0.8 |
| enzymes | 0-8 | 0-8 | 0-8 | 0.06 | 0.06 | 0.06 |
| Borax | 0-2 | 0-2 | 0-2 | 1.43 | 1.43 | 1.43 |
| Calcium Formate | 0-0.5 | 0-0.5 | 0-0.5 | 0.07 | 0.07 | 0.07 |
| ethoxylated ($EO_{15}$) tetraethylene pentaimine[4] | 0-3 | 0-3 | 0-3 | 0.3 | 0.2 | 0.2 |
| PEI 600 $EO_{20}$[5] | 0-3 | 0-3 | 0-3 | 0.65 | 0 | 0 |
| Zwitterionic ethoxylated quaternized sulfated hexamethylene diamine[6] | 0-3 | 0-3 | 0-3 | 0.8 | 0.7 | 0.7 |
| PEI 5000 $EO_7$[7] | 0-3 | 0-3 | 0-3 | 0 | 0.8 | 0 |
| PEI 5000 $EO_{10}$ $PO_7$[8] | 0-3 | 0-3 | 0-3 | 0 | 0 | 0.8 |
| diethylene triamine pentaacetate, MW = 393 | 0-0.5 | 0-0.5 | 0-0.5 | 0.15 | 0.15 | 0.15 |
| Phase stabilizers & Co-solvents | 1-10 | 1-10 | 1-10 | 5.5 | 5.5 | 5.5 |

TABLE 3-continued

| Formulations | | | | | | |
|---|---|---|---|---|---|---|
| Ingredient (assuming 100% activity) | weight % | weight % | weight % | weight % | weight % | weight % |
| Sodium Formate | 0-3 | 0-3 | 0-3 | 1.6 | 1.6 | 1.6 |
| water, perfumes, dyes, and other optional agents/components | to 100% balance | to 100% balance | to 100% balance | to 100% balance | to 100% balance | to 100% balance |

[1]$C_{10}$-$C_{18}$ alkyl ethoxy sulfate
[2]$C_9$-$C_{15}$ alkyl benzene sulfonate
[3]$C_{12}$-$C_{13}$ ethoxylated ($EO_9$) alcohol
[4]as described in U.S. Pat. No. 4,597,898
[5]as described in U.S. Pat. No. 5,565,145
[6]available under the tradename LUTENSIT ® from BASF and such as those described in WO 01/05874
[7]as described in formula (I)
[8]as described in formula (II)

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. Method for designing a liquid detergent composition comprising the steps of:

(a) selecting a surfactant system comprising from about 8% to about 18% by weight of total surfactant, wherein from 0% to about 5% of the surfactant system comprises a nonionic co-surfactant and from about 0.01% to about 9% of the surfactant system of a $C_8$-$C_{14}$ linear alkyl benzene sulfonate anionic co-surfactant;

(b) selecting a formulation salt modifier;

(c) selecting a liquid carrier being essentially free of cumene sulfonate; and (c) calculating a Formulation Tolerance by a formula $FT=(HI_C/IS)*\Sigma_y$ (weight % of surfactant y in the surfactant system) such that the FT is larger than 33, wherein $HI_C$ is the hydrophilic index of a finished liquid detergent and IS is the ionic strength of a finished liquid detergent composition.

2. The method of claim 1 further comprising the steps of:

(a) further selecting for the surfactant system from about 5% to about 17.99% by weight of the composition of a $C_{10}$-$C_{18}$ alkyl ethoxy sulfate wherein the average degree of ethoxylation is from about 1 to about 30; and (d) selecting an alkoxylated polyethyleneimine polymer.

* * * * *

UNITED STATES PATENT AND TRADEMARK OFFICE

CERTIFICATE OF CORRECTION

PATENT NO. : 7,928,050 B2
APPLICATION NO. : 12/788936
DATED : April 19, 2011
INVENTOR(S) : Eva Schneiderman et al.

It is certified that error appears in the above-identified patent and that said Letters Patent is hereby corrected as shown below:

Column 17
Line 39, delete “stifling” and insert -- stirring --.

Signed and Sealed this
First Day of May, 2012

David J. Kappos

David J. Kappos
*Director of the United States Patent and Trademark Office*